US010570534B2

(12) United States Patent
Pilar

(10) Patent No.: US 10,570,534 B2
(45) Date of Patent: Feb. 25, 2020

(54) METHOD FOR THE RESUMPTION OF THE SPINNING PROCESS ON AN AIR-JET SPINNING MACHINE, AND AN AIR-JET SPINNING MACHINE FOR PERFORMING THE METHOD

(71) Applicant: Rieter CZ s.r.o., Usti nad Orlici (CZ)

(72) Inventor: Evzen Pilar, Litomysl (CZ)

(73) Assignee: Rieter CZ s.r.o., Usti nad Orlici (CZ)

( * ) Notice: Subject to any disclaimer, the term of this patent is extended or adjusted under 35 U.S.C. 154(b) by 628 days.

(21) Appl. No.: 15/353,442

(22) Filed: Nov. 16, 2016

(65) Prior Publication Data

US 2017/0137975 A1 May 18, 2017

(30) Foreign Application Priority Data

Nov. 16, 2015 (CZ) ..... PV 2015-817

(51) Int. Cl.
*D01H 15/00* (2006.01)

(52) U.S. Cl.
CPC ..... *D01H 15/002* (2013.01)

(58) Field of Classification Search
CPC . D01H 1/115; D01H 4/40; D01H 4/48; D01H 15/00
See application file for complete search history.

(56) References Cited

U.S. PATENT DOCUMENTS 4,995,229 A * 2/1991 Stahlecker ..... B65H 54/026 57/261
5,142,856 A * 9/1992 Nakayama ..... B65H 69/00 57/22

(Continued)

FOREIGN PATENT DOCUMENTS

CZ PV 1989-2729 11/1991
CZ PV 2006-507 2/2008

(Continued)

OTHER PUBLICATIONS

Czech Republic Search Report, dated Aug. 15, 2016.

*Primary Examiner* — Shaun R Hurley
(74) *Attorney, Agent, or Firm* — Dority & Manning, P.A.

(57) ABSTRACT

A method is provided for resumption of a yarn spinning process on an air-jet spinning machine wherein, after an interruption of yarn spinning has occurred, the yarn is guided back to a working path downstream of a spinning nozzle, or the yarn is stopped in a controlled manner in the working path, with an end of the yarn situated downstream of the spinning nozzle. The yarn end is introduced into an outlet opening of the spinning nozzle, and the yarn is transported in a reverse path with the aid of the spinning nozzle and a sliver feeding device to a guide channel upstream of the spinning nozzle. A spinning-in yarn end is formed on the yarn in the guide channel, and a yarn reserve is formed in an underpressure yarn storage device upstream of a yarn winding device. Winding of the yarn onto a bobbin is started before, simultaneously with, or after the formation of the spinning-in yarn end. Before the yarn reserve from the underpressure storage device is used up by the winding of the yarn, withdrawal of the yarn by a drawing-off device is started. Following the start of the yarn withdrawal, the yarn is clamped by the sliver feeding device and feeding of new fibers through a drafting device to the sliver feeding device is started.

10 Claims, 2 Drawing Sheets

(56) References Cited

U.S. PATENT DOCUMENTS

| | | | | |
|---|---|---|---|---|
| 5,327,712 | A * | 7/1994 | Dallmann | B65H 51/205 57/22 |
| 8,904,742 | B2 | 12/2014 | Stephan et al. | |
| 2009/0094958 | A1* | 4/2009 | Weide | D01H 1/115 57/263 |
| 2013/0067879 | A1* | 3/2013 | Stephan | D01H 1/24 57/78 |
| 2014/0283496 | A1* | 9/2014 | Stahlecker | D01H 4/48 57/263 |
| 2017/0137974 | A1* | 5/2017 | Pilar | D01H 1/115 |

FOREIGN PATENT DOCUMENTS

| | | |
|---|---|---|
| DE | 10 2012 108 380 A | 12/2013 |
| EP | 0 807 669 B1 | 11/1997 |

* cited by examiner

METHOD FOR THE RESUMPTION OF THE SPINNING PROCESS ON AN AIR-JET SPINNING MACHINE, AND AN AIR-JET SPINNING MACHINE FOR PERFORMING THE METHOD

TECHNICAL FIELD

The invention relates to a method for the resumption of the spinning process on an air-jet spinning machine, in which after an interruption in the spinning process has occurred, yarn is guided back to its working path behind a spinning nozzle, or the yarn is stopped in a controlled manner in the working path with the end of yarn behind the spinning nozzle, the end of yarn being introduced to the outlet opening of the spinning nozzle. The yarn is transported by a reverse motion with the aid of the spinning nozzle and a feeding device of sliver as far as a guide channel before the spinning nozzle, where a spinning-in end of yarn is formed on the yarn in the guide channel and a yarn reserve starts to be formed in an underpressure yarn storage device in front of a yarn winding device.

BACKGROUND ART

Various techniques are used on spinning machines in order to resume spinning (yarn production) after an interruption in the spinning process has occurred, whether it is after an accidental yarn break or after a controlled interruption of spinning after receiving a signal from a yarn quality sensor or after the replacement of a fully wound bobbin with an empty tube.

The purpose of the preparation of a workstation for the resumption of the spinning process is to ensure that the individual machine parts of the workstation and, if necessary, also the parts of an attending device, adopt the required position or setting, so that the spinning-in end of yarn is ready to be spun in, and to ensure that the spinning-in end is situated in a defined initial position for starting the spinning-in process.

In the case of a sudden interruption of spinning, e.g., due to a yarn break, it is generally such a fast process that it is not possible to apply the controlled stopping of the workstation of the machine and the torn end of yarn is wound onto the bobbin. So as to resume the spinning process, it is therefore necessary to detect this yarn end on the bobbin by means of an attending device or manually, to remove the faulty yarn portion by unwinding it from the bobbin, and to guide the yarn to its working path or to a position in which it can be easily delivered to the means of the workstation. At the same time, for the resumption of the spinning process, it is necessary for the yarn end to be situated in the so-called transfer position with respect to the spinning nozzle for further operations at the working station and for delivery to the spinning nozzle to perform the final steps of the preparation of the workstation of the air-jet spinning machine for the resumption of the spinning process.

Analogous to this situation is also the preparation of the workstation for the resumption of the spinning process after the replacement of a fully wound bobbin with an empty bobbin, when the yarn end is not detected on the wound bobbin, but it is spun onto auxiliary yarn, which is usually brought by the attending device on a bobbin of auxiliary yarn. The attending device prepares the auxiliary yarn so that it could be promptly delivered to the means of the workstation. The yarn end is placed by the attending device in the so-called transfer position for further operations at the working station and for being inserted into the spinning nozzle so that the final steps of the preparation of the workstation of the air-jet spinning machine for the resumption of the spinning process can be performed.

In the case of a controlled interruption of spinning, e.g., after a signal from the yarn quality sensor, the machine parts of the workstation gradually decelerate in a coordinated manner until they come to a complete stop, i.e. to the interruption of spinning, whereby the yarn remains in the working path at the working station, its end being situated in the spinning nozzle, and so there is no need to detect it on the bobbin or set it to the so-called transfer position for further operations at the workstation and for insertion into the spinning nozzle so as to perform the final steps of the preparation of the workstation of the air-jet spinning machine for the resumption of the spinning process.

The aforementioned final steps of the preparation of the workstation of the air-jet spinning machine for the resumption of the spinning process consist in delivering the yarn end from the transfer position to the spinning nozzle and then in unwinding the required length of the yarn against the direction of the fiber feed to the spinning nozzle in the course of normal spinning in front of the spinning nozzle, where is arranged a device for the preparation of the spinning-in end of yarn, which creates the spinning-in yarn end on the unwound yarn. In the meantime, the other machine parts of the workstation get ready for starting the spinning-in process, including the formation of a yarn reserve in an underpressure yarn storage device by unwinding the yarn from the bobbin. As a result, the workstation is now ready to resume the spinning process. Subsequently, the spinning-in process is started, whereby the individual machine parts of the workstation are started, the yarn begins to be withdrawn by a yarn drawing-off mechanism and wound onto an accelerating bobbin, whereby the difference arising between the drawing-off speed and the rotational speed of the bobbin, which only gradually increases and substantially the immediate acceleration of the yarn by the drawing-off mechanism is compensated for by the underpressure yarn storage device through which the yarn passes during the acceleration of the bobbin to reach the operating speed and which is situated in front of the winding device of yarn. At a pre-defined time point, the start of the yarn withdrawal is followed by the initiation of the feed of sliver to the spinning nozzle and, consequently, the newly formed yarn is connected to the spinning-in end of yarn in the spinning nozzle.

The above-mentioned techniques are disclosed, for example, in the solution according to DE 10 2012 108 380 A1.

The problem of the background art is the continuing certain variability of the position of the spinning-in yarn end, which is created by interrupting the yarn, usually by tearing the yarn in a device for the preparation of the spinning-in yarn end, which consequently negatively affects the uniformity of the piecers at one workstation, as well as at different workstations. Another drawback is the fact that part of the yarn with the spinning-in yarn end, i.e. the part which passes through the spinning nozzle and during spinning-in the newly formed yarn is connected to its end, i.e. to the spinning-in end, has only a limited length defined by the length of the yarn path between the device for forming the spinning-in yarn end and the spinning nozzle. In some cases this length appears to be insufficient, since for high-quality and uniform piecers it is advantageous if the spinning-in yarn end reaches a certain speed at the moment of the connection and moves at a relatively constant speed.

The aim of the invention is therefore to eliminate or at least minimize the disadvantages of the background art.

SUMMARY OF THE INVENTION

Additional objects and advantages of the invention will be set forth in part in the following description, or may be obvious from the description, or may be learned through practice of the invention.

An aim of the invention is achieved by a method for preparing a workstation to resume the spinning process on an air-jet spinning machine, whose principle consists in that, after the formation of a spinning-in yarn end, the winding of yarn on a bobbin is started, while a drawing-off mechanism is out of operation, whereupon before a yarn reserve from an underpressure yarn storage device is used up, the yarn starts to be drawn off by the drawing-off mechanism. Following the start of the yarn withdrawal, the yarn is clamped by a rotating sliver feeding device and the feed of new fibers to the feeding device through a drafting device is started.

The advantage of this invention is the fact that it enables to obtain stable piecers at all the workstations of the machine.

DESCRIPTION OF DRAWINGS

The invention is schematically represented in the drawing, where.

DETAILED DESCRIPTION

Figure 1:
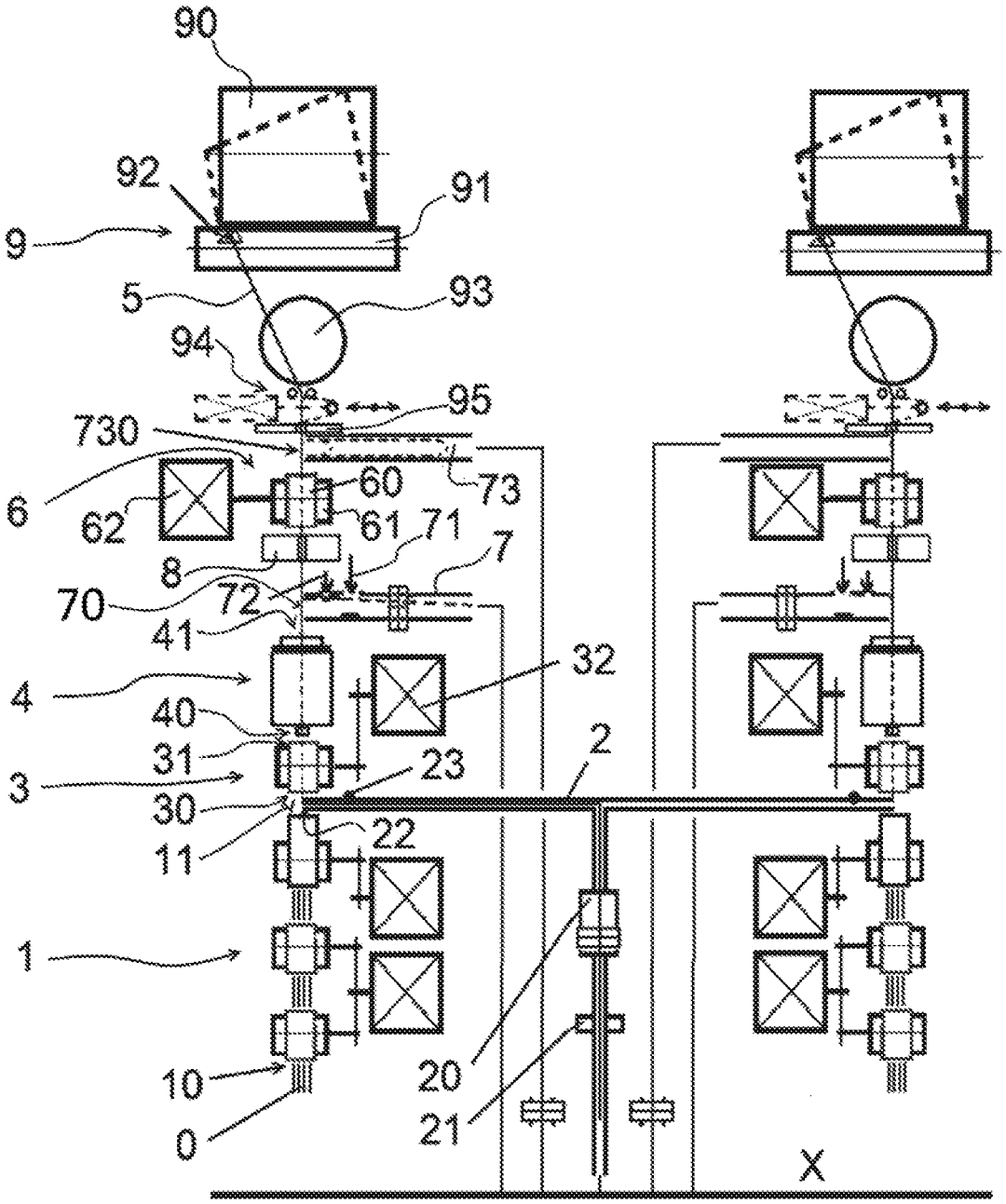
FIG. 1 shows an arrangement of a workstation of an air-jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The invention will be described on an example of embodiment of a workstation of an air-jet spinning machine, which comprises at least one row of identical workstations arranged next to each other.

The workstation comprises a drafting mechanism 1 of sliver 0, which is with its inlet 10 aligned with an unillustrated source of sliver and which is with its outlet 11 aligned with the inlet 30 of the sliver feeding device 3, which is coupled to a drive 32. The sliver feeding device 3 is with its outlet 31 aligned with the entry 40 of the fibers to the spinning nozzle 4. In the spinning nozzle 4, the entering sliver 0 is converted into yarn 5, which is withdrawn by a drawing-off mechanism 6 arranged behind (downstream) the yarn outlet opening 41 of the spinning nozzle 4.

The drawing-off mechanism 6 comprises a pair of rollers 60, 61, which are pressed towards each other, one of them being coupled to a rotary drive 62 and the other being rotatably mounted on a pressure arm (not shown), which is tiltably mounted in the construction of the workstation.

Between the outlet opening 41 of the spinning nozzle 4 and the yarn drawing-off mechanism 6, there is a suction inlet 70 of a suction tube 7 aligned with the working path of yarn 5. The suction tube 7 is in a controlled manner connected to a source X of underpressure. In the suction tube 7 is arranged a device 71 for interrupting yarn 5 and a device 72 for delivering the yarn end to the nozzle 4.

Between the suction tube 7 and the yarn drawing-off mechanism 6 is arranged a yarn quality sensor 8, which is connected to the control systems of the workstation and/or of a section of workstations and/or of the machine.

A winding device 9 of yarn 5 onto a bobbin 90 is disposed in the path of the yarn 5 behind the drawing-off mechanism 6. During winding, the bobbin 90 lies on a drive cylinder 91, which drives it by rolling, whereby the yarn 5 is guided along the width of the bobbin 90 by a guide 92 of the yarn guiding device. In the illustrated embodiment, before the traverse guide 92, the yarn passes through a waxing device 93, in front of which is, in the case conical bobbins are being wound, arranged a compensator 94 of yarn loops in the path of the yarn 5, the yarn loop being formed periodically during the winding of conical bobbins 90. In front of the compensator 94, in the path of the yarn 5, is disposed a yarn presence sensor 95, which during yarn production operates in the mode of a yarn break detector.

Between the yarn presence sensor 95 and the drawing-off mechanism 6, adjacent to the path of the yarn 5, with its suction inlet 730, is arranged an underpressure yarn storage device 73, which is connected to an underpressure source X.

For the resumption of the spinning process at the working station, in the space between the outlet 11 of the drafting mechanism 1 and the inlet 30 of the feeding device 3, there is an assignable exit portion 22 of a yarn guide channel 2, whereby this exit portion 22 is, in the course of normal spinning, either completely displaced outside the space between the outlet 11 of the drafting mechanism 1 and the inlet 30 of the feeding device 3, or it is fixed and situated outside the path of the sliver 0. The guide channel 2 is, with its other end, connected to the underpressure source X. The guide channel 2 is, at a distance from its exit portion 22, provided with a device 20 for the preparation of the yarn spinning-in end. In the direction away from the exit portion 22 of the guide tube 2 behind the device 20 for the preparation of the yarn spinning-in end, the guide channel 2 is provided with the yarn presence sensor 21 in the guide channel 2.

In the illustrated embodiment, in the space between the inlet 30 of the sliver feeding device 3 and the device 20 for the preparation of the yarn spinning-in end in the guide channel 2, or, more specifically, between the inlet 40 of the spinning nozzle 4 and the device 20 for the preparation of the yarn spinning-in end in the guide channel 2, is arranged a securing element 23 (keeper) of the yarn free end 5, which is, in the illustrated embodiment, part of the exit portion 22 of the guide channel 2.

The preparation of the workstation for the resumption of the spinning process after its interruption due to a defect occurring in the produced yarn 5, whereby the defect of yarn 5 is recorded by the yarn quality sensor 8, is performed in such a manner that once the yarn quality sensor 8 has recorded a yarn defect, the workstation starts stopping the spinning process smoothly according to the instructions of a control mechanism (not shown). From the point of view of minimizing the duration of the individual operations at the working station, i.e. the time periods necessary for the individual operations, the individual machine parts of the workstation are braked, or, more specifically, stopped in a controlled way as fast as possible to a complete stop, when the yarn 5 is in its working path, in which it is situated during spinning, its end being situated in the spinning nozzle 4 or above the nozzle 4 in the area of the suction inlet 70 of the suction tube 7.

Subsequently, the suction of yarn by the suction tube 7 is started, by which means the yarn 5 end, situated in the spinning nozzle 4, is pulled out from the spinning nozzle 4 and is sucked into the suction tube 7. After that, the unwinding of the defective portion of yarn 5 from the bobbin 90 is started when the rotation of the bobbin is reversed against the direction in which yarn 5 is wound onto the bobbin during spinning and, simultaneously, the yarn is drawn off from the bobbin 90 by means of drawing-off rollers 60, 61 rotating reversely. During the unwinding of the defective portion of yarn 5, the defective yarn 5, which is being unwound, passes also through the yarn quality sensor 8 and is sucked into the suction tube 7, which is in a controlled manner connected to the source of underpressure and from which the defective yarn 5 is further sucked off to the waste (not shown). Thus, the defective length of yarn 5 is unwound from the bobbin 90 and from the working path at the working station to the waste, whereby it is continuously "cut" by the device 71 for the interruption of yarn 5 in the suction tube 7, so that smaller pieces of defective yarn are sucked off to the waste instead of a long section.

Once the defective yarn 5 has been removed by the suction tube 7, the faultless yarn 5, i.e. the yarn 5 before a defect detection, is already situated in the part of the working path at the working station in the area between the bobbin 90 and the suction tube 7.

Subsequently, the last part of the yarn 5 is separated by the device 71 in the suction tube 7 and is sucked off to the waste, and consequently the faultless yarn 5 is held by the drawing-off mechanism 6 the end of the faultless yarn being situated in the suction tube 7 in the area of the device 72 for passing the end of yarn on to the nozzle 4.

The preparation of the workstation to resume the spinning process after its interruption due to a yarn break is performed in such a manner that an unillustrated attending device detects the end of yarn on the bobbin 90, winds it off from the bobbin, and passes it on to the workstation means above the nozzle 4. The end of yarn created by a break is removed either by the attending device before passing the yarn 5 on to the workstation means, or it is removed in the suction tube 7 at the workstation, whereby the suction tube 7 separates the last part of the yarn 5 and sucks it off to the waste, so that the faultless yarn 5 is then held by the drawing-off mechanism 6 the end of the faultless yarn being situated in the suction tube 7 in the area of the device 72 for passing the end of yarn on to the nozzle 4.

Subsequently, the free end of yarn 5 is moved from the suction tube 7 to the outlet opening 41 of the spinning nozzle 4, e.g., by blowing once the process of suction by the suction tube 7 has been completed, by being sucked into the outlet opening 41 of the spinning nozzle 4 etc.

As soon as the end of the faultless yarn 5 is back in the spinning nozzle 4 another phase of unwinding the yarn 5 is started with the aid of the reverse motion of the yarn drawing-off mechanism 6, i.e. the motion in the direction against the direction of the motion of the yarn 5 during yarn 5 formation, through the spinning nozzle 4, the sliver feeding device 3 to the exit portion 22 of the guide channel 2, and to the securing element 23 (keeper) of the yarn free end, and further on to the guide channel 2.

The sliver feeding device 3 is open, i.e. the pressure feed roller is lifted off.

The purpose of the unwinding of the faultless yarn 5 to the guide channel 2, is to form a sufficient length of the faultless yarn 5 for the subsequent realization of spinning-in and formation of a high-quality piecer. For creating this length of the faultless yarn 5, it is either measured during the unwinding of the yarn 5, e.g., by the number of the revolutions of the drawing-off rollers 60, 61 rotating reversibly, or by measuring the duration of the reverse motion of the yarn drawing-off mechanism 6, or it is signaled by the yarn presence sensor 21 in the guide channel 2. At the moment of signaling the sufficient length of the faultless yarn 5 in the guide channel 2 the speed of the yarn drawing-off mechanism 6 decreases in relation to the speed of the bobbin 90 rotation, whereby the speed of the yarn drawing-off mechanism 6 decreases to a complete stop. Thus, due to the difference in the speeds of yarn 5 in the yarn drawing-off mechanism 6 and on the bobbin 90 being unwound, a yarn loop is formed. The yarn 5 loop is sucked into the underpressure yarn storage device 73 as yarn 5 reserve for the start-up of the individual machine parts of the workstation during the process of spinning-in, especially for the start-up of the yarn winding device 9. Stopping the yarn drawing-off mechanism 6 results in the stopping of the faultless yarn 5 in the guide channel 2.

In front of the yarn presence sensor 21, a spinning-in yarn end is formed by the device 20 for the preparation of yarn 5 in the guide channel 2. During the formation of the spinning-in yarn end, the speed of unwinding the yarn 5 from the bobbin 90 (in case of need) increases or decreases by means of the rotation of the bobbin 90 so as to form the required length of the yarn 5 reserve in the underpressure yarn storage device 73 for the start-up of the individual machine parts of the workstation during spinning-in, but at the same time so as to avoid overfilling the storage device, or, optionally, the unwinding of the yarn 5 from the bobbin 90 is stopped during the formation of the spinning-in yarn end in the guide channel 2.

The yarn presence sensor 21 in the guide channel 2 registers the suction of the torn end of yarn 5 in the device 20 for the preparation of the spinning-in yarn end in the guide channel 2, by which means the formation of the spinning-in yarn end is confirmed.

Subsequently, the formed spinning-in yarn 5 end is moved by the reverse motion of the yarn drawing-off mechanism 6 to the yarn presence sensor 21 in the guide channel 2 or behind the yarn presence sensor 21 in the guide channel 2, and consequently the spinning-in yarn end is moved further on in the direction of its insertion into the guide channel 2 behind the device 20 for the preparation the spinning-in yarn end, i.e. to the position behind the place of the formation of the spinning-in yarn end. In this phase, the drawing-off mechanism 6 has preferably the same speed as the bobbin 90 (the unwinding of the yarn from the bobbin 90), therefore the reserve of the yarn 5 in the underpressure yarn storage device 73 is not changed significantly. If the drawing-off mechanism 6 has in this phase a different speed than the bobbin 90 (the unwinding of the yarn from the bobbin 90), the yarn 5 reserve in underpressure yarn storage device 73 is not changed and it has to be subsequently regulated (restocked, reduced) for the subsequent process of spinning-in with a defined length of the yarn reserve in underpressure yarn storage device 73.

After that, the unwinding of the yarn 5 is terminated and the yarn is then arranged at the working station along the entire length from the bobbin 90 to the sliver feeding device 3 in its working path, and in the guide channel 2 is arranged the defined length of yarn 5 with a spinning-in end on the level or behind the level of the yarn presence sensor 21 in the guide channel 2. At that point, all the machine parts of the workstation are stopped and are prepared for the start-up of the spinning-in process, including the pressure feed roller being moved to the position for spinning-in.

During the first phase of the unwinding of the yarn 5, i.e. unwinding to the suction tube 7, the spinning nozzle 4 is cleaned at the workstation and the spinning nozzle 4 is prepared for the second phase of the unwinding of the yarn 5, i.e. the unwinding of the yarn 5 to the guide channel 2, whereupon the preparation for spinning-in and spinning is carried out. During the first and/or also the second phase of the unwinding of the yarn 5 at the working station, those machine parts of the workstation which do not take part in the unwinding are prepared for the spinning-in process and at the same time the preparation of sliver 0 for spinning-in is performed.

Now the workstation is ready to start the spinning-in process.

The yarn 5 passing between the drawing-off rollers 60, 61 of the drawing-off device 6 is behind (downstream) the spinning nozzle 4 clamped by the drawing-off rollers 60, 61, which do not rotate. Before (upstream) the spinning nozzle 4, the yarn 5 passes between the feeding rollers of the sliver feeding device 3. Subsequently, the winding of the yarn 5 onto the bobbin 90 is started, as indicated by arrow A in FIG. 2. As a result of this, the winding speed of the yarn 5 begins to increase, as illustrated by the line R indicating the rise in the rotation speed of the bobbin 90 in FIG. 2, whereupon the yarn 5 reserve in the underpressure yarn storage device 73 starts to be consumed, as shown by line S in FIG. 2. Following the initiation of the winding of the yarn 5 on the bobbin 90 the yarn 5 traversing starts as well. Before the whole yarn 5 reserve from the underpressure storage device 73 is consumed, i.e. at the time point indicated by arrow B in FIG. 2, the drawing-off rollers 60, 61 of the drawing-off device 6 begin to rotate. The acceleration of the drawing-off rollers 60, 61 is considerably faster in comparison to the bobbin 90. After starting the drawing-off mechanism 6 the yarn 5 starts to be pulled out of the guide channel 2 and thus with a small delay yarn 5 is temporarily stopped and the yarn reserve in the underpressure storage device 73 of yarn 5 begins to increase again, as indicated by line S in FIG. 2 after time point B, since the drawing-off speed of the yarn 5 starts with a small delay to exceed the winding speed of the yarn 5, as is indicated by the arrangement of lines R and T after point B in FIG. 2, where line T indicates the course of the drawing-off speed of the yarn 5.

According to a particular arrangement, the yarn 5 is clamped by the rotating sliver feeding device 3 simultaneously with the start of the yarn 5 withdrawal or after a predetermined time delay from the start of the yarn 5 withdrawal. According to another preferred embodiment, the yarn 5 is clamped by the rotating sliver feeding device 3 only after the start of the yarn 5 withdrawal, namely immediately after receiving a signal from the yarn quality sensor 21 in the guide channel 2 at the workstation about the passage of the spinning-in yarn end through the yarn quality sensor 21 in the guide channel 2 at the workstation, or it is clamped after a time delay following receipt of a signal of the yarn quality sensor 21 in the guide channel 2 at the workstation about the passage of the spinning-in yarn end through the yarn quality sensor 21 in the guide channel 2 at the workstation. According to another preferred embodiment, the yarn 5 is not clamped by the rotating sliver feeding device 3 until the withdrawal of yarn 5 is started, namely after metering the predetermined length of yarn of yarn 5 withdrawn by the drawing-off device 6.

Figure 2:
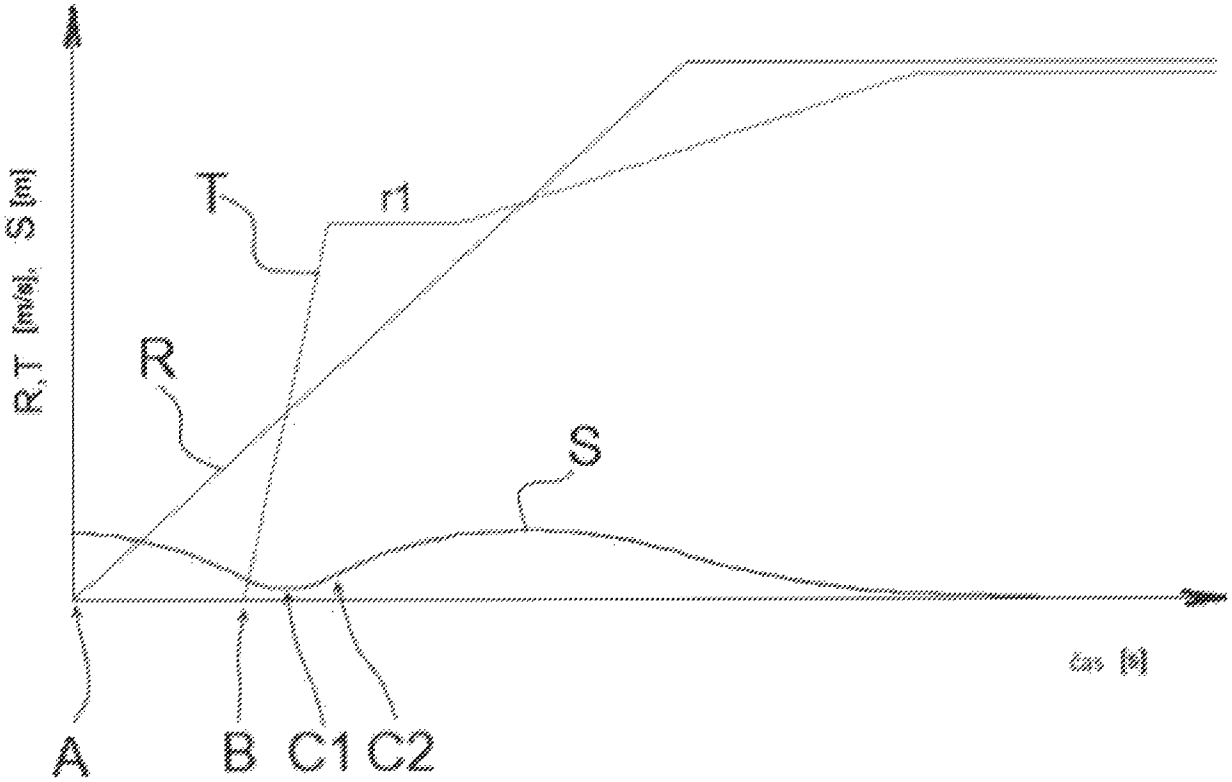
FIG. 2 shows an example of timing the individual steps performed at the workstation to resume the spinning process.

Before or at the moment of the yarn 5 being clamped by the rotating sliver feeding device 3, the feeding device 3 starts to rotate, as is illustrated by the arrows B, C1, C2 in FIG. 2, whereby before clamping the yarn 5 the pressure roller of the sliver feeding device 3 is held in the prepared position, and so the yarn 5 is not driven in this prepared position. The acceleration speed of the sliver feeding device 3 to reach the feeding speed during the yarn production depends on whether it is the running yarn 5 or standing yarn 5 that is to be clamped by the rotating sliver feeding device 3. According to this, the sliver feeding device 3 accelerates to reach a predetermined speed or it accelerates from zero to reach the predetermined speed only after clamping the yarn 5. The clamping of the yarn 5 itself is carried out, for example, by releasing the pressure roller of the feeding device 3 from a prepared position, whereby the pressure roller abuts the other driven roller of the sliver feeding device 3, by which means the sliver feeding device 3 clamps the withdrawn yarn 5 and is able to drive it.

Following the clamping of the yarn 5 by the sliver feeding device 3, the feed of new sliver 0 through the drafting device 1 to the feeding device 3 is commenced in such a manner that the new fibers arrive at the most suitable moment with respect to the moment when the spinning-in yarn end enters the sliver feeding device 3 and the spinning nozzle 4, in order to produce a stable and quality piecer and to resume the spinning process, so that the predetermined (required) length of the piecer is created. Therefore the feed of the new fibers of sliver 0 through the drafting device 1 to the sliver feeding device 3 is started either by timing from the start of the drawing-off mechanism 6, or on receipt a signal from the yarn presence sensor 21 in the guide channel 2 at the workstation about the passage of the spinning-in yarn end through the yarn presence sensor 21 in the guide channel 2, or after a time delay following receipt of a signal of the yarn presence sensor 21 in the guide channel 2 at the workstation about the passage of the spinning-in yarn end through the yarn presence sensor 21 in the guide channel 2, or after metering the predetermined length of the yarn 5 withdrawn by the drawing-off mechanism 6, e.g., by measuring the number of revolutions of one drawing-off roller 60 or 61, etc.

Also, for the quality, stability and uniformity of the piecers, it is essential that the speed of the moving spinning-in yarn end is constant at the moment of connection. Therefore the whole process of spinning-in according to this invention proceeds to a point when it is accelerated by the drawing-off mechanism 6 to reach the first speed $r_1$, and the spinning-in yarn end arrives at the sliver feeding device 3 and the spinning nozzle 4 only after reaching the first speed $r_1$ of the yarn 5 withdrawal, and so the feed of the new fibers to the sliver feeding device 3 and to the spinning nozzle 4 is started after reaching the first speed $r_1$ of the yarn 5 withdrawal, whereby this first speed $r_1$ of the yarn 5 withdrawal is maintained for a specified period of time during which the formation of the piecer takes place. After the specified time for the piecer formation, the drawing-off mechanism 6 further accelerates to reach the production speed, as indicated by line T in FIG. 2. During this whole period of time, the bobbin 90 accelerates without interruption up to the production speed, which manifests itself at first by a decrease in the yarn 5 reserve in the underpressure storage device 73 of the yarn 5, see the course of line S in FIG. 2, followed by a short-term increase in the yarn 5 reserve in the underpressure storage device 73 of the yarn 5 caused by the acceleration of the drawing-off mechanism 6 to the first speed $r_1$ of the yarn 5 withdrawal and by spinning-in and subsequent decrease in the yarn 5 reserve and complete emptying of the underpressure storage device 73 with the yarn 5 reserve after both the drawing-off mechanism 6 of yarn 5 and the bobbin 90 reach the production speed of rotation.

Following the yarn drawing-off mechanism, also the other machine parts of workstation accelerate to reach the production speed.

According to another preferred embodiment, the first speed $r_1$ is a production speed, i.e. the speed of the yarn production, and therefore the working bodies of the workstation do not accelerate any longer after reaching the first speed $r_1$.

According to another preferred embodiment, during the spinning-in process, the bobbin 90 accelerates smoothly from zero to the full winding speed, or, if needed, to temporarily increased speed above the production speed before slowing to the production speed.

Apparently, some of the operations described here can be performed by the attending device or by the machine operators instead of the means of the workstation, e.g. in the case of the resumption of spinning after the replacement of a fully wound bobbin with an empty tube, when the so-called auxiliary yarn is used for spinning-in, the auxiliary yarn being brought to the workstation either by the attending device or by the machine operator.

The invention can be used on textile machines for the resumption of the spinning process.

The invention claimed is:

1. A method for resumption of a yarn spinning process on an air-jet spinning machine wherein, after an interruption of yarn spinning has occurred, the yarn is guided back to a working path downstream of a spinning nozzle, or the yarn is stopped in a controlled manner in the working path, with an end of the yarn situated downstream of the spinning nozzle, the method comprising:

introducing the yarn end into an outlet opening of the spinning nozzle;

transporting the yarn in a reverse path with the aid of the spinning nozzle and a sliver feeding device to a guide channel upstream of the spinning nozzle;

forming a spinning-in yarn end on the yarn in the guide channel;

forming a yarn reserve in an underpressure yarn storage device upstream of a yarn winding device;

starting winding of the yarn onto a bobbin before, simultaneously with, or after the formation of the spinning-in yarn end;

after starting of the winding of the yarn and before the yarn reserve from the underpressure storage device is used up by the winding of the yarn, withdrawal of the yarn by a drawing-off device is started; and following the start of the yarn withdrawal, the yarn is clamped by the sliver feeding device and feeding of new fibers through a drafting device to the sliver feeding device is started.

2. The method according to claim 1, wherein, after starting, the drawing-off device is accelerated to a first speed (r1), wherein the spinning-in yarn end arrives at the sliver feeding device and at the spinning nozzle at or after yarn withdrawal reaching the first speed (r1) and the feed of new fibers through the drafting device to the sliver feeding device and to the spinning nozzle is started after yarn withdrawal reaches the first speed (r1), wherein after formation of a piecer at the first speed (r1) of yarn withdrawal, the drawing-off device accelerates up to production speed.

3. The method according to claim 2, wherein the first speed (r1) is the production speed of the yarn production.

4. The method according to claim 1, wherein after starting winding of the yarn onto a bobbin, the bobbin accelerates smoothly from zero to production speed, or to a temporarily increased speed that is higher than the production speed before slowing to the production speed.

5. The method according to claim 1, wherein the yarn is clamped by the sliver feeding device simultaneously with the start of the yarn withdrawal or after a time delay after the start of the yarn withdrawal.

6. The method according to claim 1, wherein after the yarn withdrawal is started, the yarn is clamped by the sliver feeding device upon receipt of a signal, or after a time delay from receipt of the signal, from a yarn presence sensor in the guide channel indicating passage of the spinning-in yarn end through the yarn presence sensor.

7. The method according to claim 1, wherein after the yarn withdrawal is started, the yarn is clamped by the sliver feeding device once a predetermined length of the yarn has been withdrawn by the drawing-off device.

8. The method according to claim 1, wherein the feeding of new fibers through the drafting device to the sliver feeding device is started following the start of the yarn withdrawal.

9. The method according to claim 1, wherein the feeding of new fibers through the drafting device to the sliver feeding device is started after a predetermined time interval after receipt of a signal from a yarn presence sensor in the guide channel indicating passage of the spinning-in yarn end through the yarn presence sensor.

10. The method according to claim 1, wherein the feed of new fibers through the drafting device to the sliver feeding device is started after a predetermined length of the yarn has been withdrawn by the drawing-off device.

* * * * *